US009840834B2

(12) United States Patent
Blum et al.

(10) Patent No.: US 9,840,834 B2
(45) Date of Patent: Dec. 12, 2017

(54) JET REGULATOR

(71) Applicant: NEOPERL GMBH, Mullheim (DE)

(72) Inventors: Gerhard Blum, Gutach (DE); Christoph Weis, Mullheim (DE)

(73) Assignee: NEOPERL GMBH, Mullheim (DE)

( * ) Notice: Subject to any disclaimer, the term of this patent is extended or adjusted under 35 U.S.C. 154(b) by 10 days.

(21) Appl. No.: 14/442,366

(22) PCT Filed: Nov. 2, 2013

(86) PCT No.: PCT/EP2013/003294
§ 371 (c)(1),
(2) Date: May 12, 2015

(87) PCT Pub. No.: WO2014/075767
PCT Pub. Date: May 22, 2014

(65) Prior Publication Data

US 2016/0273199 A1 Sep. 22, 2016

(30) Foreign Application Priority Data

Nov. 13, 2012 (DE) ..... 20 2012 010 798 U

(51) Int. Cl.
*E03C 1/00* (2006.01)
*E03C 1/08* (2006.01)
*E03C 1/04* (2006.01)

(52) U.S. Cl.
CPC ..... *E03C 1/08* (2013.01); *E03C 2001/0414* (2013.01); *E03C 2201/70* (2013.01)

(58) Field of Classification Search
CPC . E01C 1/09; E01C 2001/0414; E01C 2201/70
USPC .... 239/428.5, 432, 461, 463, 466, 494, 495, 239/496, 500, 504, 587.1–587.5, 239/589–590.5; 137/801
See application file for complete search history.

(56) References Cited

U.S. PATENT DOCUMENTS 2,797,906 A * 7/1957 Aghnides ..... E03C 1/084 137/872
2008/0210777 A1* 9/2008 Lacher ..... E03C 1/08 239/140

(Continued)

FOREIGN PATENT DOCUMENTS

DE 19852411 A1 5/2000
DE 10313501 A1 10/2004

(Continued)

*Primary Examiner* — Viet Le
(74) *Attorney, Agent, or Firm* — Volpe and Kienig, P.C.

(57) ABSTRACT

The invention relates to a jet regulator (1) having an annular or sleeve-shaped jet regulator housing (2), on the outlet end side of which there is held an outlet disc (3) which can be inserted into the jet regulator housing (2), which (3) has a perforated, grid and/or mesh structure with throughflow openings (5), wherein the outlet disc (3) bears a manually deformable dimensionally elastic plastics lining (4), and wherein the plastics lining (4) is of pot-shaped design. In order to reduce the production expenditure, it is provided according to the invention that the plastics lining (4), with an upwardly drawn circumferential wall (16) of its pot shape, provides sealing between the outer circumference of the outlet disc (3) and the housing inner circumference of the jet regulator housing (2).

25 Claims, 4 Drawing Sheets

(56) References Cited

U.S. PATENT DOCUMENTS

| | | | |
|---|---|---|---|
| 2012/0228409 | A1 | 9/2012 | Lacher et al. |
| 2013/0008980 | A1 | 1/2013 | Grether |

FOREIGN PATENT DOCUMENTS

| | | | |
|---|---|---|---|
| DE | 202010002325 | U1 | 8/2011 |
| DE | 102010012326 | A1 | 9/2011 |
| EP | 1619315 | A1 | 1/2006 |
| WO | 2006092316 | A2 | 9/2006 |

* cited by examiner

JET REGULATOR

INCORPORATION BY REFERENCE

The present application is a Section 371 National Phase of International Patent Application No. PCT/EP2013/003294, filed Nov. 2, 2013, which claimed priority of German Patent Application No. 20 2012 010 798.4, filed Nov. 13, 2012, the entire contents of all of which are incorporated by reference in their entirety herein as if fully set forth.

FIELD OF THE INVENTION

The invention relates to a jet regulator having a ring-shaped or sleeve-shaped jet regulator housing in which there is provided a jet splitter dividing the inflowing water into a multiplicity of individual jets, and having a manually deformable, dimensionally elastic plastic lining provided on the outlet end side of the jet regulator housing, which is of cup-shaped design, and in that the plastic lining, by means of a raised circumferential wall of the cup shape thereof, seals against the housing inner circumference of the jet regulator housing.

BACKGROUND

DE 20 2010 002 325 Ul has already disclosed a jet regulator having a sleeve-shaped jet regulator housing. In the jet regulator housing of the already known jet regulator there is provided a jet splitter which has the task of splitting up the inflowing water into a multiplicity of individual jets. Jet splitter has a central cam-shaped hollow which, on its circumferential wall, has throughflow openings which are spaced apart from one another in the circumferential direction. On the outflow end side of the jet regulator housing there is provided a manually deformable, dimensionally elastic plastic lining which is of cup-shaped design. Said cup-shaped plastic lining has a multiplicity of outlet openings which are bordered by teat-like projections, which protrude on the outlet side, of the plastic lining. In this case, the soft elastic plastic lining is stiffened by way of a perforated disk which forms the outflow end side of the jet regulator housing and the holes of which are extended through by the teat-like projections of the plastic lining.

Since the circumferential edge of the cup-shaped plastic lining must be sealed with respect to the housing inner circumference of the jet regulator housing, said circumferential edge is inclined with its inflow-side end edge toward the housing inner circumference. The mere inclination of the inflow-side end edge of the plastic lining however is not adequate, in particular in the presence of high water pressures, for preventing leakage flows between, on the one hand, the plastic lining and, on the other hand, the housing inner circumference of the jet regulator housing.

DE 198 52 411 A1 has already disclosed a jet regulator which can be mounted on a sanitary outlet fitting. The previously known jet regulator has a jet regulator housing which is in the form of a sleeve-shaped molded body on which a soft or dimensionally elastic plastic material is injection molded on the outlet side. That part of the jet regulator housing which is composed of soft or dimensionally elastic plastic material forms a soft and/or water-repellent surface, the aim of which is to avoid limescale formation. It is the intention for adherent limescale deposits to be easily detachable by slight manual deformation of the soft or dimensionally elastic plastic material which is injection molded on the surface. Since it should be ensured with regard to the selection of material that the soft or dimensionally elastic plastic material can be injection molded onto the relatively hard or dimensionally rigid plastic material of the jet regulator housing, the production of the previously known jet regulator can require a not inconsiderable amount of additional outlay.

A jet regulator having a sleeve-shaped jet regulator housing, the outlet end side of which is designed as an outlet disk which is insertable into the jet regulator housing and bears a flat grate structure with throughflow openings is already known from FIGS. 3 to 5 of DE 198 52 411 A1. regulator housing of the previously known jet regulator is formed from two housing halves which bear against each other in a longitudinal center plane and between which the flat grate structure can be inserted before the housing halves are shut. Said grate structure has a very thin coating made from a soft and/or water-repellent plastic material which can be applied by dip coating or by spraying onto the grate structure, which is in the form of a plastic injection molded part. The water-repellent plastic layer is intended substantially to oppose limescale formation at the outlet end of the jet regulator housing. By means of the soft configuration of said plastic layer, cleaning of the outlet end surface is intended to be facilitated since the possibly adhering limescale deposits are easily detachable by slight manual surface deformation. The grate structure, which is in the form of a plastic injection molded part, of the jet regulator previously known from DE 198 52 411 A1 is dimensionally stable in such a manner that said grate structure can be inserted into the housing interior only before the housing halves of the longitudinally divided jet regulator housing are shut. Since the soft coating is applied by dip coating or by spraying and since the soft coating is correspondingly thin, the plastic injection molded part of the grate structure has to be sufficiently flexible at the same time in order to achieve a surface deformation which can detach adhering limescale deposits. The grate structure of the previously known jet regulator is therefore formed in such a flat manner that the wall sections surrounding the throughflow openings of the grate structure cannot simultaneously also act as flow guiding walls.

A jet regulator, the jet regulator housing of which is deformable, at least in the region of the liquid outlet, from an undeformed functional position into a shape-changed cleaning position is already known from DE 103 13 501 A1. The deformability of the housing that is achievable here by manual pressurization is greater than the breaking elongation capacity of deposits adhering to the housing and is dimensioned in such a manner that such deposits can be detached from the housing. Since, in the case of the jet regulator previously known from DE 103 13 501 A1, the jet regulator housing is optionally intended to have deformability defined in such a manner only in a partially delimited partial region, the production of the previously known jet regulator and of the jet regulator housing thereof, which is of complex configuration, is associated with a considerable outlay.

A jet regulator of the type mentioned at the beginning having a jet regulator housing, on the outlet end side of which an outlet disk which is insertable into the jet regulator housing is held, which disk has a perforated, grate or mesh structure with throughflow openings, wherein the outlet disk bears a manually deformable, dimensionally elastic plastic lining is already known from DE 10 2010 012 326. In order to be able to produce such a jet regulator from the most varied materials with comparatively little outlay, the outlet disk is configured as a multicomponent injection molded part, the main or molded body of which is produced from hard or dimensionally rigid plastic material, wherein the main or molded body is encapsulated with a part composed of relatively soft or dimensionally elastic plastic material by injection molding, and wherein the throughflow openings of the perforated, grate and/or mesh structure are bounded by flow guiding walls. Despite the separate configuration, the production of the multi-part injection molded part serving as an outlet disk requires a considerable outlay. In order to be able to produce such a multi-component injection molded part, in particular from different materials, complex injection molding dies, in which the various materials can be processed according to the processing conditions required for this purpose, are required. The provision of complex injection molding dies and the different production steps adapted to the various materials necessitate a considerable outlay on costs.

It is therefore in particular the object to create a structurally simple and functionally reliable jet regulator of the type mentioned at the beginning, which can be produced with as little outlay as possible.

SUMMARY

This object is achieved according to the invention, in the case of the jet regulator of the type mentioned at the beginning, in particular in that, on the outlet end side, there is held an outlet disk which is insertable into the jet regulator housing and which has a perforated, grate and/or mesh structure with throughflow openings, in that the outlet disk bears the manually deformable, dimensionally elastic plastic lining, in that the plastic lining, by way of its raised circumferential wall, provides a seal between the outer circumference of the outlet disk and the housing inner circumference of the jet regulator housing, and in that a central cam is integrally formed on the jet splitter on the outflow side, said cam, during the pivoting of the outlet disk, is supported on the latter or on a central cam integrally formed on the outlet disk on the inflow side.

Jet regulator according to the invention has a jet regulator housing which is of ring-shaped or sleeve-shaped configuration. An outlet disk which is insertable into the jet regulator housing is held on the outlet end side of the jet regulator housing. Said outlet disk which has a perforated, grate and/or mesh structure with throughflow openings likewise bears a manually deformable, dimensionally elastic plastic lining which can be freed from timescale deposits by manual pressurization and deformation. The plastic lining here is of cup-shaped design in such a manner that the plastic lining, by means of a raised circumferential wall of the cup shape thereof, provides a seal between the outer circumference of the outlet disk and the housing inner circumference of the jet regulator housing. This avoids undesirable leakage flows in the region between the outlet disk and the housing inner circumference of the jet regulator housing, which leakage flows could otherwise impair the jet pattern of the jet regulator according to the invention. Since the plastic lining, by means of a raised circumferential wall of the cup shape thereof, provides a seal between the outer circumference of the outlet disk and the housing inner circumference of the jet regulator housing, and since the outlet disk bearing the plastic lining is therefore inserted into the jet regulator housing, a modular system is also possible, in which the outlet disk bearing the plastic lining is exchangeable for another outlet disk with or else without a plastic lining in order to be able to change, for example, the material properties and/or the throughflow characteristics of the jet regulator according to the invention as required.

In order that the water flowing through can be shaped in an effective manner in the jet regulator according to the invention, it is provided that the jet regulator has a jet splitter dividing the inflowing water into a multiplicity of individual jets. A central cam is integrally formed on said jet splitter on the outflow side. Said cam provided on the jet splitter is, during the pivoting of the outlet disk, supported on said outlet disk or on a central cam integrally formed on the outlet disk on the inflow side, in such a way that a pivoting movement of the unit formed from outlet disk and plastic lining is facilitated.

It can be advantageous here if the plastic lining is held releasably or non-releasably on the outlet disk. If the plastic lining is held non-releasably on the outlet disk, the outlet disk bearing the plastic lining can be produced in a simple manner, for example as a multi-component injection molded part. If, by contrast, the plastic lining is held releasably on the outlet disk, the plastic lining and the outlet disk can be produced separately from each other. Since the outlet disk and the plastic lining held releasably thereon are produced separately from each other, comparatively simple injection molding dies can be used for this purpose, and the production steps can be carried out regardless of different material properties. The plastic lining is fixed here on the outlet disk as a separately produced component.

In order to be able to fix a plastic lining, which is produced separately from the outlet disk, on the outlet disk securely and fixedly and nevertheless with little outlay, it is advantageous if the plastic lining is held in an interlocking manner on the outlet disk.

In a particularly advantageous embodiment according to the invention, in which the plastic lining provides a complete seal between the outlet disk and the housing inner circumference of the jet regulator housing, the plastic lining is held by the free edge region of the circumferential wall thereof, which edge region faces away from the cup base, in an interlocking manner on the outlet disk.

The separately produced plastic lining of the jet regulator according to the invention can be clamped and fixed in a simple manner between the outlet disk and the housing inner circumference of the jet regulator housing. However, in order not to impair the movability of these parts of the jet regulator according to the invention and in order always to ensure the correct functioning of the jet regulator, it can be expedient if the free edge region of the circumferential wall, which edge region faces away from the cup base, is angled inward in such a manner that said edge region engages behind the inflow-side circumferential end edge of the outlet disk. In this embodiment, the plastic lining together with the outlet disk forms a very substantially immovable unit, although the plastic lining is merely held releasably in the outlet disk.

In addition or instead, however, the plastic lining can have, on the free edge region of the circumferential wall thereof, which edge region faces away from the cup base, on the inner circumferential side at least one preferably encircling recessed or projecting retaining molding which interacts with a projecting or recessed retaining molding on the outer circumference of the outlet disk.

In order to be able to fix the plastic lining on the outlet disk with little outlay and in order to be able to bring the throughflow openings provided in the outlet disk into overlap with the throughflow openings arranged in the plastic lining, it is advantageous if positioning aids corresponding with each other are provided on the plastic lining, on the one hand, and on the outlet disk, on the other hand, said positioning aids ensuring a positionally correct relative position between the plastic lining, on the one hand, and the outlet disk, on the other hand. In an advantageous embodiment according to the invention, positioning aids corresponding with each other in each case in pairs are provided on the inner side of the plastic lining and on the outer side of the outlet disk.

In order to be able to connect the outlet disk to the plastic lining and/or in order to be able easily to produce the relative position between the plastic lining and the outlet disk during the assembly, it is advantageous if the outlet disk, on the outflow-side end side thereof, has at least one connecting pin or a connecting opening, which connecting pin/connecting opening interacts with a connecting opening or a connecting pin on that end side of the plastic lining which faces the outlet disk.

In a preferred development according to the invention, the plastic lining, on the inflow side outer circumference thereof, has at least one encircling sealing lip or sealing lug which seals with/against the inner circumference of the jet regulator housing. Such a plastic lining, the outer circumference of which has at least one encircling sealing lip or sealing lug, is capable of particularly readily sealing the region between the outlet disk, on the one hand, and the housing inner circumference of the jet regulator housing, on the other hand.

In a preferred embodiment according to the invention, which, with the aid of the jet regulator according to the invention, also permits the water jet emerging from the jet regulator to be oriented, the outlet disk together with the plastic lining carried by the latter is held pivotably in the jet regulator housing. The outflow direction of the outflowing water jet can be changed as required by pivoting the unit, which consists of outlet disk and plastic lining, in the jet regulator housing.

In a structurally simple and particularly advantageous embodiment according to the invention, the outlet disk and/or the plastic lining encasing the latter is designed in the shape of a spherical segment on the outer circumference thereof, and the pivoting disk formed in this manner is mounted pivotably in a partial region, which is configured as a joint socket, on the housing inner circumference of the jet regulator housing. In this embodiment, for example, the unit formed from outlet disk and plastic lining can form a pivoting disk which is in the manner of a ball joint and is mounted pivotably in the joint socket provided in the housing interior of the jet regulator housing.

In order that the unit formed from the outlet disk and the plastic lining is held fixedly in the housing interior of the jet regulator housing even in the event of high water pressures, in a preferred development according to the invention the outlet disk is insertable into the housing interior of the jet regulator housing through an inflow-side insertion opening as far as the partial region configured as a joint socket.

It is advantageous if the outlet disk and the plastic lining have throughflow openings merging into each other. The throughflow openings which are provided in the outlet disk and the plastic lining and merge into each other are therefore bounded by guide walls which orient the individual jets formed in the throughflow openings in direction to form the jet angle defined by the relative position of the outlet disk.

In order to be able to form a homogeneous overall jet with the aid of the jet regulator according to the invention, it is advantageous if the throughflow openings of the outlet disk and those of the plastic lining are arranged on preferably coaxial hole circles.

In a preferred embodiment according to the invention, the throughflow openings arranged on an outer hole circle are provided in an encircling ring wall of the plastic lining.

In order, when required, also to be able to produce a spray jet with the aid of the jet regulator according to the invention, said spray jet being formed from a multiplicity of individual jets approximately oriented in the same direction, it is advantageous if the throughflow openings provided in the plastic lining taper preferably conically at least over a partial region of the longitudinal extent thereof in the direction of flow.

Possible limescale deposits can be detached particularly easily if an outflow-side partial region of at least one throughflow opening and preferably of the throughflow openings arranged at least on the inner hole circles is provided in a teat projecting over the plastic lining or in a projection.

In addition or instead, it can be advantageous if the cam provided on the jet splitter is supported on the cam of the outlet disk during the pivoting of said outlet disk.

In order to prevent excessive pivoting of the outlet disk and in order always to ensure correct functioning of the jet regulator designed as a pivoting jet regulator, it is advantageous if a component inserted into the jet regulator housing upstream of the outlet disk on the inflow side is designed a pivoting stop for the outlet disk which is configured as a pivoting disk.

In a preferred embodiment according to the invention, which ensures a fixed support of the parts forming the jet regulator according to the invention, a cup-shaped insertion part, the inflowside cup base of which is configured as a jet splitter, is insertable into the jet regulator housing.

In a particularly advantageous development according to the invention, the jet splitter has a central and preferably cam-shaped hollow, the circumferential wall of which has throughflow openings which are spaced apart from one another in the circumferential direction. This central and preferably cam-shaped hollow is formed virtually as an overflow in which the water flowing into the jet regulator according to the invention is deflected and is conducted further through the throughflow openings provided on the circumferential wall. By means of this deflection of the throughflowing water in the region of the jet splitter, the water is retarded and is first of all divided into individual jets in order subsequently to be conducted further in the housing interior of the jet regulator according to the invention. This deflection and further conduction of the throughflowing water in the jet regulator according to the invention promotes the formation of a homogeneous and soft water jet.

The assembly of the jet regulator according to the invention is facilitated if the insertion part is held in the jet regulator housing in a releasable manner and in particular in a frictional and/or interlocking manner.

In particular in the case of greatly fluctuating water pressures, it can be advantageous if a throughflow quantity regulator is connected upstream of the jet regulator on the inflow side, and if the throughflow quantity regulator is held on the jet splitter preferably in a releasably connected manner and in particular in a latchable manner.

BRIEF DESCRIPTION OF THE DRAWINGS

Developments according to the invention emerge from the claims in conjunction with the description and the figures. The invention is described in further detail below with reference to advantageous exemplary embodiments.

In the figures.

DETAILED DESCRIPTION OF THE PREFERRED EMBODIMENTS

Figures 1, 2, 3, 4, 5, 6:
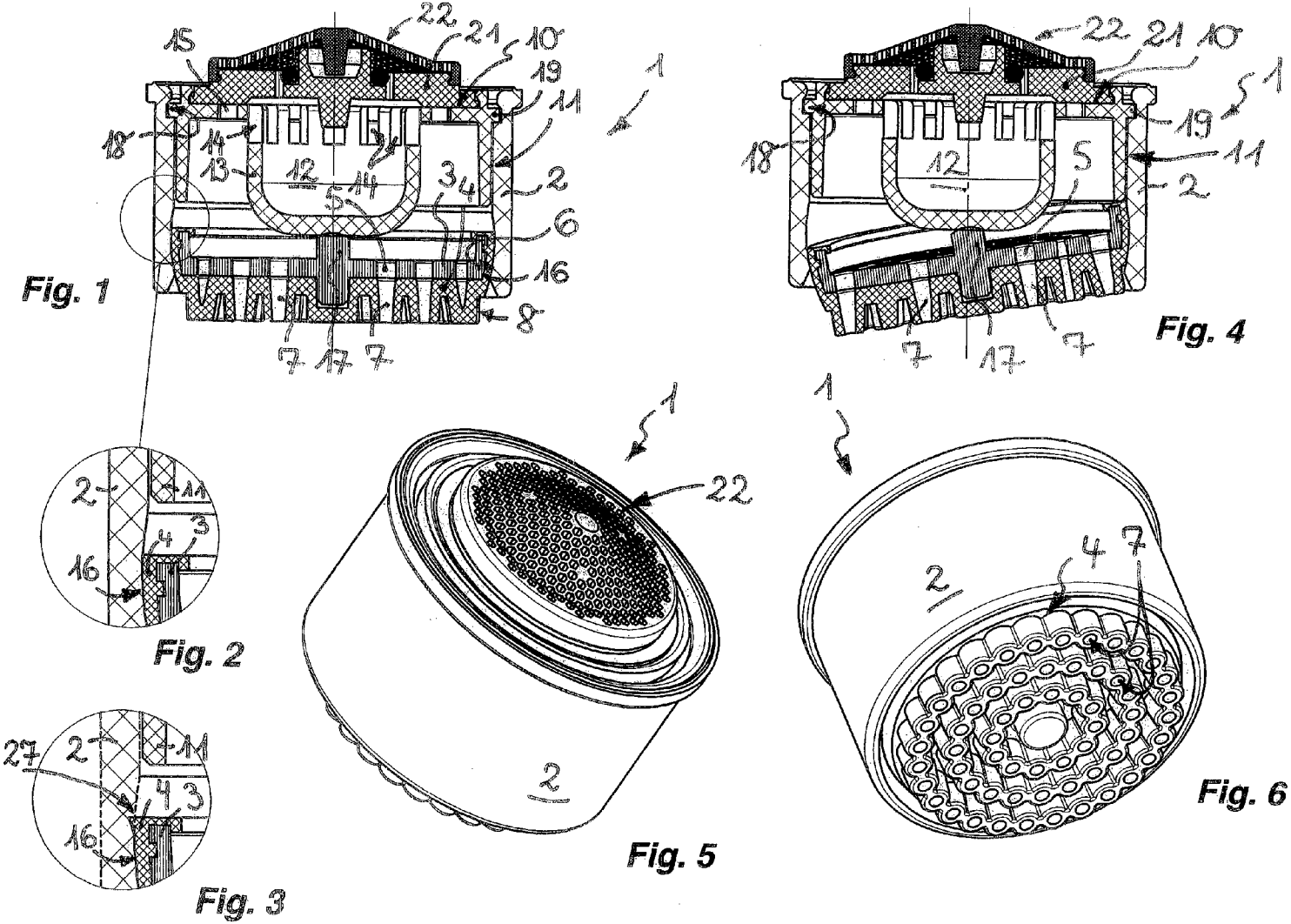
FIG. 1 shows a jet regulator which is illustrated in a longitudinal section and is designed as a pivoting jet regulator and the outlet end side of which is formed for this purpose by an outlet disk which is configured as a pivoting disk and bears a plastic lining.
FIG. 2 shows the jet regulator from FIG. 1 in a longitudinal section of a detail in the region between the outlet disk, the plastic lining and the adjacent jet regulator housing.
FIG. 3 shows the plastic lining, which is fixed releasably on the outlet disk, of the jet regulator shown in FIGS. 1 and 2 in a relaxed starting position, wherein the designated installation position of the jet regulator housing is merely indicated by dashed lines.
FIG. 4 shows the jet regulator from FIGS. 1 to 3 in a longitudinal section, wherein the unit formed from outlet disk and plastic lining is held in a pivoted position in the jet regulator housing.
FIG. 5 shows the jet regulator from FIGS. 1 to 4 in a perspective side view of the inflow side of the jet regulator.
FIG. 6 shows the jet regulator from FIGS. 1 to 5 in a perspective side view of the outflow side of the jet regulator.

FIGS. 1 to 11 illustrate a jet regulator in various embodiments 1, 100 and 101. The jet regulator 1, 100, 101 is fittable on the water outlet of a sanitary outlet fitting (not shown specifically) in order to form a homogeneous and non-spraying, optionally also sparkling and soft water jet. The jet regulator embodiments 1, 100, 101 illustrated here are configured as a spray jet regulator in which the emerging water jet is formed from a plurality of individual jets emerging approximately axially parallel to one another.

The jet regulator 1, 100, 101 has a ring-shaped or sleeve-shaped jet regulator housing 2, on the outlet end side of which an outlet disk 3 insertable into the jet regulator housing 2 is held. Said outlet disk 3 bears a manually deformable, dimensionally elastic plastic lining 4 which can be freed from limescale deposits by manual pressurization and deformation. In the case of the jet regulator 1, 100, 101, said plastic lining 4 produced from dimensionally elastic plastic is manufactured separately from the outlet disk 3, which is composed, in contrast, of harder material and in particular harder plastic material, and is subsequently held releasably on the outlet disk 3. Since the outlet disk 3 and the plastic lining 4 held releasably thereon are produced separately from each other, comparatively simple injection molding dies can be used for this purpose, and the production steps can be carried out regardless of different material properties. Since the plastic lining 4 is held releasably on the outlet disk 3, a modular system is also possible, in which the one plastic lining 4 is replaceable by another plastic lining in order to be able to change, for example, the material properties and/or the throughflow characteristics of the jet regulator when required. The plastic lining 4 here is of cup-shaped design, specifically in such a manner that the plastic lining 4, by means of a raised circumferential wall 16 of the cup shape thereof, provides a seal between the outer circumference of the outlet disk 3 and the housing inner circumference of the jet regulator housing 2.

The outlet disk 3 and the plastic lining 4 have throughflow openings 5, 7 which merge into each other and in each case form a perforated, grate and/or mesh structure and here a perforated structure.

It can be seen in FIG. 4 that the outlet disk 3 is held pivotably together with the plastic lining 4, which is provided thereon, in the jet regulator housing 2. The outlet disk 3 and also the plastic lining 4 here together form a pivoting disk which is in the shape of a spherical segment on the outer circumference thereof and is mounted pivotably in a partial region, which is configured as a joint socket 6, on the housing inner circumference of the jet regulator housing 2.

It can be seen in FIGS. 1, 4, 8 and 10 that the outlet disk 3 and the plastic lining 4 held thereon are insertable into the housing interior of the jet regulator housing 2 through an inflow-side insertion opening in the jet regulator housing 2 as far as the partial region configured as a joint socket 6. It can also be seen in FIGS. 1, 4, 8 and 10 that the throughflow openings 5, 7 of the outlet disk 3 and of the plastic lining 4 are arranged on concentric hole circles. At least the throughflow openings 7 arranged on an outer hole circle, and here the throughflow openings 7 arranged on all of the hole circles, in the plastic lining 4 are provided in an encircling ring wall 7 of the plastic lining 4. It is also possible that an outflow-side partial region at least of the throughflow openings 7 arranged on the inner hole circles is provided in each case in a teat projecting over the plastic lining 4 or in a projection.

It can be seen in the longitudinal sections according to FIGS. 1, 4, 8 and 10 that the throughflow openings 7 provided in the plastic lining 4 taper conically at least over a partial region of the longitudinal extent thereof in the flow direction.

A cup-shaped insertion part 11, the inflow-side cup base of which is configured as a jet splitter 10, is insertable into the jet regulator housing 2 of the jet regulator 1, 100, 101. Said jet splitter 10 has a central and here cam-shaped hollow 12, the circumferential wall 13 of which has throughflow openings 14 which are preferably spaced apart from one another uniformly in the circumferential direction. The outflow-side circumferential end edge of the insertion part 11 arranged upstream of the outlet disk 4 on the inflow side is designed as a pivoting stop for the unit which serves as a pivoting disk and is formed from outlet disk 3 and plastic lining 4.

Openings 15 are provided around the central hollow 12 of the jet splitter 10, at a radial distance from the hollow 12, said openings being arranged in a coaxial hole circle around the hollow 12. The water flowing into the jet regulator housing 2 is deflected in the hollow 12 and is conducted further through the throughflow openings 14 into the housing interior of the jet regulator housing 2. In the process, the individual jets formed in the throughflow openings 14 are deflected and, in the housing interior of the jet regulator housing 2, the resulting swirling of said individual jets forms a mixing zone which promotes the production of a soft and homogeneous water jet.

The insertion part 11 is held releasably and in particular in a form-fitting manner in the jet regulator housing 2. For this purpose, a latching flange 18 is provided on the circumferential side of the cup-shaped insertion part 12, said latching flange engaging in a latching groove 19 on the housing interior circumference of the jet regulator housing 2.

It can be seen in the longitudinal sections according to FIGS. 1, 4, 8 and 10 that the hollow 12 forms a central cam on the outflow side of the jet splitter 10. Said cam which is provided on the outflow side of the jet splitter 10 is acted upon by a cam or pin 17 which projects on the inflow side of the outlet disk 3. When the outlet disk 3 and the plastic lining 4 held thereon are pivoted, the cams integrally formed on the jet splitter 10, on the one hand, and on the outlet disk 3, on the other hand, are supported on each other. It can seen in FIG. 4 that the insertion part 11 which is inserted upstream of the outlet disk 4 forms a pivoting stop for the unit consisting of outlet disk 3 and plastic lining 4, which unit is configured as a pivoting disk.

In the illustration of individual parts according to the figures, it can be seen that the outlet disk 3 and the plastic lining 4 of the jet regulator embodiments 1, 100, 101 are held on one another in a manner secure against rotation. For this purpose, at least one longitudinal flute or similar securing groove 23 is provided the one component 3 or 4, in which a securing projection 24 on the other component 4 or 3 in each case engages.

From a comparison of FIGS. 1 to 4, it becomes clear that, in the case of the jet regulator 1, the free edge region 20 of the circumferential wall provided on the plastic lining 4, which free edge region faces away from the cup base, is angled inwards in such a manner that said edge region 20 engages behind the inflow-side circumferential end edge of the outlet disk 3. By contrast, in the case of the jet regulator 100, the outlet disk 3 is merely inserted into the plastic lining 4 and is held securely between the jet regulator housing 2 and the insertion part 11 in the housing interior of the jet regulator housing. In order to adjust the throughflow capacity to a maximum value independently of the pressure, a throughflow quantity regulator 21 is connected upstream of the jet regulators 1, 100, 101. Said throughflow quantity regulator 21 is held releasably, and in particular is latchable releasably, on the jet splitter 10 on the inflow side. An ancillary or filter screen 22 which has to retain dirt particles is placed onto the throughflow quantity regulator 21.

Figure 8:
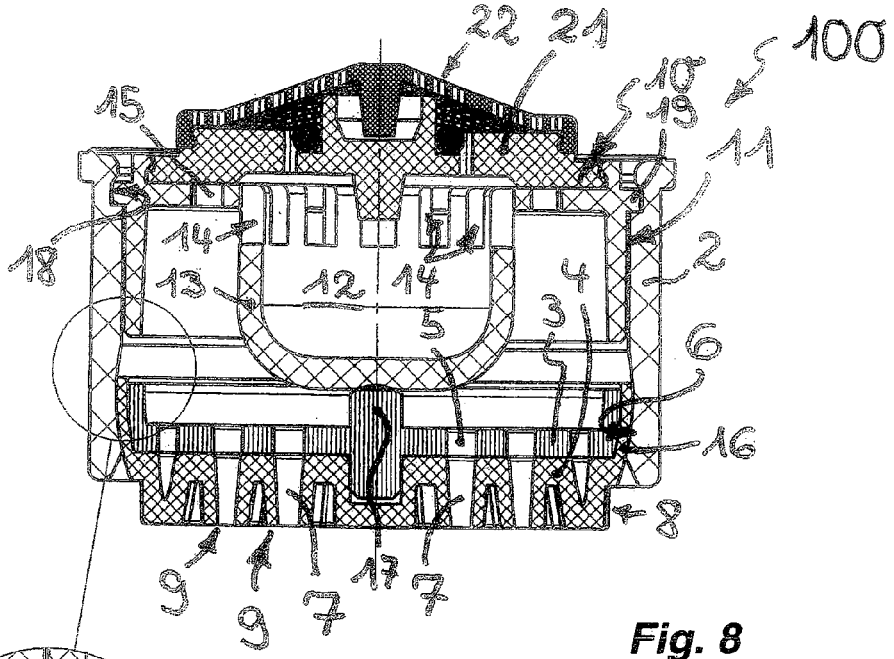
FIG. 8 shows a jet regulator configured comparably to FIGS. 1 to 7 in a longitudinal section in which the outlet disk is merely placed into the cup-shaped plastic lining.
Figure 9:
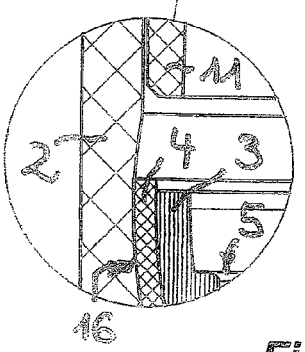
FIG. 9 shows the jet regulator from FIG. 8 in a longitudinal section of a detail in the region between outlet disk, plastic lining and jet regulator housing.

While, in the case of the jet regulator 100 according to FIGS. 8 and 9, the outlet disk 3 is merely placed into the cup-shaped plastic lining 4, said parts 3, 4 of the jet regulator 1, 100 are connected to each other in a form-fitting manner. For this purpose, the plastic lining 4 is held by the free edge region of the circumferential wall thereof, which edge region faces away from the cup base, in a form-fitting manner on the outlet disk 3. It can be seen in FIGS. 1 to 4 that the free edge region 20 of the circumferential wall, which edge region faces away from the cup base, can be angled inward in such a manner that said edge region 20 engages behind the inflow-side circumferential end edge of the outlet disk 3. In addition (cf. FIGS. 1 to 4) or instead (cf. FIGS. 10 and 11), the plastic lining 4 can have, on the free edge region of the circumferential wall thereof, which edge region faces away from the cup base, on the inner circumferential side at least one preferably encircling recessed retaining molding and/or, as here, projecting retaining molding 28, which interacts with a projecting retaining molding or recessed retaining molding 29 on the outer circumference of the outlet disk 3.

In order that the outlet disk 3 and the plastic lining 4 have throughflow openings 5, 7 merging into each other, a defined relative position between said parts 3, 4 should be ensured. In order to be able to ensure the desired relative position between plastic lining 4 and outlet disk 3, it is expedient if positioning aids corresponding with each other in each case in pairs are provided on the inner side of the plastic lining 4 and on the outer side of the outlet disk 3. It can thus be seen in the illustration of the individual parts according to FIG. 7 that the outlet disk 3 and the plastic lining 4 are held on each other in a manner secured against rotation. For this purpose, at least one longitudinal groove or similar positioning groove 23 is provided on the one component 3 or 4, in which a positioning projection 24 on the other component 4 or 3 in each case engages. In addition or instead, it is possible that the outlet disk 3, on the outflow-side end side thereof, has at least one connecting pin or, as here, a connecting opening 25, which connecting pin/connecting opening interacts with a connecting opening or a connecting pin 26 on that end side of the plastic lining 4 which faces the outlet disk 3. In the case of the jet regulator 101 according to FIGS. 10 and 11, the connecting opening 25 provided in the outlet disk 3 is designed as a continuous connecting opening through which the connecting pin 26 projecting on the plastic lining 4 counter to the flow direction passes.

It is indicated in FIG. 3 that the plastic lining 4, on the inflow-side outer circumference thereof, has at least one encircling sealing lip or sealing lug 27 which seals against the inner circumference of the jet regulator housing 2.

Figure 7:
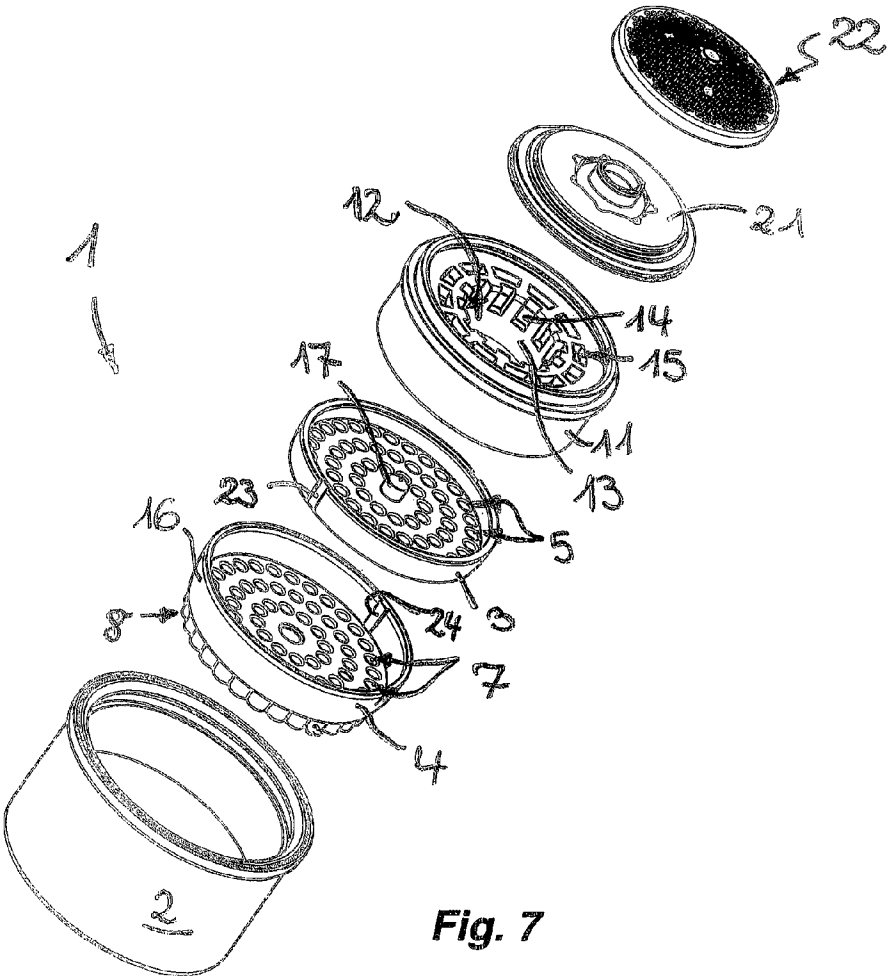
FIG. 7 shows the jet regulator from FIGS. 1 to 6 in a perspective illustration of individual parts.

From an overall view of FIGS. 6 and 7, it becomes clear that the throughflow openings 5, 7 of the outlet disk 3 and of the plastic lining 4 are arranged on concentric hole circles. It can be seen in FIG. 6 that the throughflow openings 7 of the plastic lining 4, which throughflow openings are arranged on at least one hole circle, preferably on an outer hole circle and here on all of the hole circles, are in each case provided in an encircling ring wall 8 of said plastic lining 4. However, it is also possible for an outflow-side partial region of at least one throughflow opening 7 and preferably of the throughflow openings 7 arranged on the inner hole circles to be provided in a teat projecting over the plastic lining 4, or in a projection.

The position of plastic lining 4 and outlet disk 3 by means of the connecting openings 25 and connecting pins 26 interacting in pairs is advantageous in particular in the production of the jet regulator since rapid assembly is possible because it can immediately be seen that the connecting pin 26 of the plastic lining 4 is possibly not introduced into the connecting opening 25 of the outlet disk 3 in a suitable position. Leakage cannot occur in the region of said positioning aids 25, 26 since the connecting pin 26 projecting on the plastic lining 4 is composed of elastic material, and therefore an additional anchoring is achieved by mushroom-head-like deformation of the connecting pin 26 at the free pin end thereof after the connecting pin 26 is introduced into the connecting opening 25. In any case, leakage in this region would only lead to the leakage water emerging on the outflow side from one of the throughflow openings 7.

LIST OF REFERENCE NUMBERS

Figure 10:
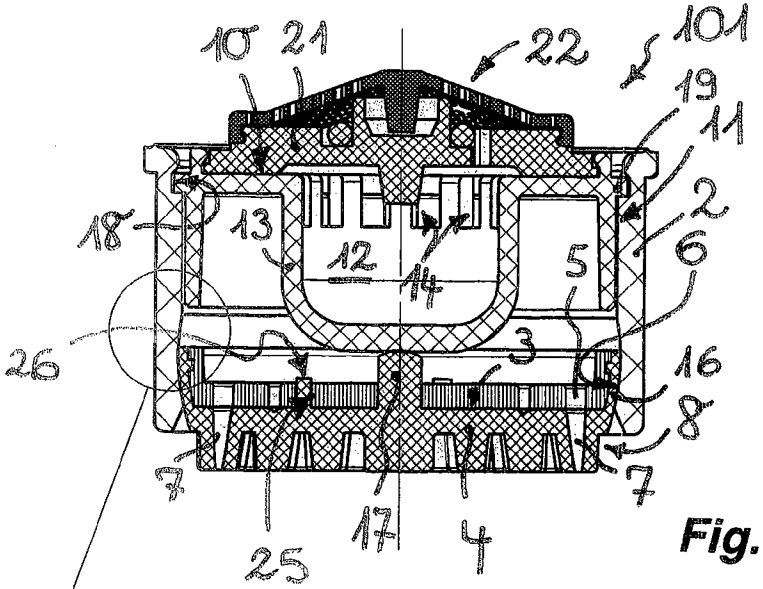
FIG. 10 shows a jet regulator which is configured comparably to the jet regulators shown in FIGS. 1 to 9 and in which the disk outer circumference of the outlet disk has an encircling recessed molding which is in the form of a groove, in which recessed molding a likewise encircling, complementarily shaped projecting molding, which is in the form of a latching projection, on the inner circumference of the plastic lining is held.
Figure 11:
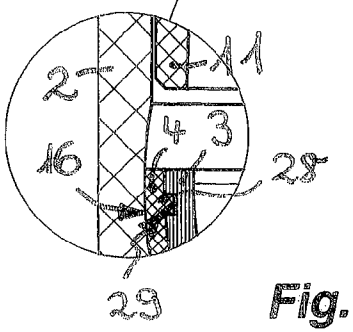
FIG. 11 shows the jet regulator from FIG. 10 in a longitudinal section of a detail in the region between outlet disk, plastic lining and jet regulator housing.

1 Jet regulator (according to FIGS. 1 to 7)
2 Jet regulator housing
3 Outlet disk
4 Plastic lining
5 Throughflow openings (of the outlet disk 3)
6 Joint socket
7 Throughflow openings (of the plastic lining 4)
8 Ring wall
9 Teat or projection
10 Jet splitter
11 Insertion part
12 Hollow
13 Circumferential wall
14 Throughflow openings (on the circumferential wall 13)
15 Throughflow openings (at a radial distance from the hollow 12 of the jet splitter 10)
16 Circumferential wall
17 Cam or pin
18 Latching groove
19 Latching flange
20 Edge region
21 Throughflow quantity regulator
22 Ancillary screen
23 Positioning groove
24 Positioning projection
25 Connecting opening
26 Connecting pin
27 Sealing lug
28 Projecting retaining molding
29 Recessed retaining molding
100 Jet regulator (according to FIGS. 8 and 9)
101 Jet regulator (according to FIGS. 10 and 11)

What is claimed is:

1. Jet regulator (1, 100, 101) having a ring-shaped or sleeve-shaped jet regulator housing (2) in which there is provided a jet splitter (10) dividing inflowing water into a multiplicity of individual jets, and having a manually deformable, dimensionally elastic plastic lining (4) provided on the outlet end side of the jet regulator housing (2), said manually deformable dimensionally elastic plastic lining (4) is cup-shaped and comprises a raised circumferential wall (16), which seals against an inner circumference of the jet regulator housing (2), on the outlet end side, there is held an outlet disk (3) which is insertable into the jet regulator housing (2) and is pivotable therein, the outlet disk (3) has a perforated, grate and/or mesh structure with throughflow openings (5), and the outlet disk (3) bears the manually deformable, dimensionally elastic plastic lining (4), the raised circumferential wall (16), provides a seal between the outer circumference of the outlet disk (3) and the housing inner circumference of the jet regulator housing (2), and a central cam is integrally formed on the jet splitter (10) on the outflow side, said cam, during the pivoting of the outlet disk (3), is supported on the outlet disk (3) or on a central cam (17) integrally formed on the outlet disk (3) on an upstream side and wherein the outlet disk (3) and the manually deformable dimensionally elastic plastic lining (4) are held on one another in a manner secure against rotation and have throughflow openings (5, 7) merging into each other.

2. The jet regulator (100) according to claim 1, wherein the manually deformable dimensionally elastic plastic lining (4) is held releasably or non-releasably on the outlet disk (3).

3. The jet regulator according to claim 1, wherein the manually deformable dimensionally elastic plastic lining (4) is held in an interlocking manner on the outlet disk (3).

4. The jet regulator according to claim 3, wherein the manually deformable dimensionally elastic plastic lining (4) is held by a free edge region of the raised circumferential wall (16) thereof, said edge region faces away from a base of the manually deformable dimensionally elastic plastic lining (4), in an interlocking manner on the outlet disk (3).

5. The jet regulator according to claim 4, wherein the free edge region (20) of the raised circumferential wall (16), said free edge region faces away from the base, is angled inward in such a manner that said edge region (20) engages behind the inflow-side circumferential end edge of the outlet disk (3).

6. The jet regulator according to claim 5, wherein an insertion part (11), an inflow-side cup base of which is configured as a jet splitter (10), is insertable into the jet regulator housing (2).

7. The jet regulator according to claim 1, wherein the manually deformable dimensionally elastic plastic lining (4) has, on a free edge region of the raised circumferential wall (16) thereof, said edge region faces away from a base of the manually deformable dimensionally elastic plastic lining (4), on an inner circumferential side, at least one encircling recessed or projecting retaining molding (29) which interacts with a projecting or recessed retaining molding (28) on the outer circumference of the outlet disk (3).

8. The jet regulator according to claim 1, wherein positioning aids corresponding with each other in pairs are provided on an inner side of the manually deformable dimensionally elastic plastic lining (4) and on an outer side of the outlet disk (3).

9. The jet regulator according to claim 1, wherein the outlet disk (3), on the outflow-side end side thereof, has at least one connecting pin (26), which interacts with at least one connecting opening (25) interacts with at least one connecting on an end side of the manually deformable dimensionally elastic plastic lining (4) which faces the outlet disk.

10. The jet regulator according to claim 1, wherein the manually deformable dimensionally elastic plastic lining (4), on an inflow-side outer circumference thereof, has at least one encircling sealing lip or sealing lug (27) which seals with/against the inner circumference of the jet regulator housing.

11. The jet regulator according to claim 1, wherein the outlet disk (3) and the manually deformable dimensionally elastic plastic lining (4) are held pivotably with each other in the jet regulator housing (2), which is configured as a joint socket.

12. The jet regulator according to claim 1, wherein the outlet disk (3) and/or the manually deformable dimensionally elastic plastic lining (4) have a spherical outer circumference, and the pivoting disk formed in this manner is mounted pivotably in a partial region, which is configured as a mating joint socket (6), on the housing inner circumference of the jet regulator housing (2).

13. The jet regulator according to claim 12, wherein the outlet disk (3) is insertable into the housing interior of the jet regulator housing (2) through an inflow-side insertion opening as far as the partial region configured as a joint socket (6).

14. The jet regulator according to claim 1, wherein the throughflow openings (5, 7) of the outlet disk (3) and of the manually deformable dimensionally elastic plastic lining (4) are arranged on concentric hole circles.

15. The jet regulator according to claim 14, wherein the throughflow openings (7) arranged on at least one hole circle, and on an outer hole circle, are provided in an encircling ring wall (8) of the manually deformable dimensionally elastic plastic lining (4).

16. The jet regulator according to claim 14, wherein an outflow-side partial region of at least one throughflow opening (7) and of the throughflow openings (7) arranged on an inner hole circles is provided in a teat projecting over the manually deformable dimensionally elastic plastic lining (4) or in a projection.

17. The jet regulator according to claim 1, wherein the throughflow openings (7) provided in the manually deformable dimensionally elastic plastic lining (4) taper conically at least over a partial region of the longitudinal extent thereof in the direction of flow thereof.

18. The jet regulator according to claim 1, wherein the cam (17) provided on the outlet disk (3) is supported on the cams of the jet splitter (10) during the pivoting of the outlet disk (3).

19. The jet regulator according to claim 1, wherein an insertion part (11) inserted into the jet regulator housing (2) upstream of the outlet disk (3) on the upstream side is configured as a pivoting stop for the outlet disk (3) which is configured as a pivoting disk.

20. The jet regulator according to claim 1, wherein an insertion part (11) is held in the jet regulator housing (2) in a releasable manner and in a frictional and/or interlocking manner.

21. The jet regulator according to claim 1, further comprising a throughflow quantity regulator (21) connected upstream of the jet regulator (1, 100, 101) on an inflow side, and the throughflow quantity regulator (21) is held on the jet splitter (10) in a releasably connected latchable manner.

22. Jet regulator (1, 100, 101) having a ring-shaped or sleeve-shaped jet regulator housing (2) in which there is provided a jet splitter (10) dividing inflowing water into a multiplicity of individual jets, and having a manually deformable, dimensionally elastic plastic lining (4) provided on the outlet end side of the jet regulator housing (2), said manually deformable dimensionally elastic plastic lining (4) is cup-shaped and comprises a raised circumferential wall (16), which seals against an inner circumference of the jet regulator housing (2), on the outlet end side, there is held an outlet disk (3) which is insertable into the jet regulator housing (2) and is pivotable therein, the outlet disk (3) has a perforated, grate and/or mesh structure with throughflow openings (5), and the outlet disk (3) bears the manually deformable, dimensionally elastic plastic lining (4), the raised circumferential wall (16), provides a seal between the outer circumference of the outlet disk (3) and the housing inner circumference of the jet regulator housing (2), and a central cam is integrally formed on the jet splitter (10) on the outflow side, said cam, during the pivoting of the outlet disk (3), is supported on the outlet disk (3) or on a central cam (17) integrally formed on the outlet disk (3) on an upstream side, the outlet disk (3) and the manually deformable dimensionally elastic plastic lining (4) are held on to one another in a manner secure against rotation, wherein the jet splitter (10) has a central hollow (12), a circumferential wall (13) of which has throughflow openings (14) which are spaced apart from one another in the circumferential direction.

23. The jet regulator according to claim 22, wherein the jet splitter (10) has recessed moldings or openings (15) around the central hollow (12) at a radial distance therefrom, said recessed moldings or openings are arranged in a coaxial hole circle around the hollow (12).

24. Jet regulator (1, 100, 101) having a ring-shaped or sleeve-shaped jet regulator housing (2) in which there is provided a jet splitter (10) dividing inflowing water into a multiplicity of individual jets, and having a manually deformable, dimensionally elastic plastic lining (4) provided on the outlet end side of the jet regulator housing (2), said manually deformable dimensionally elastic plastic lining (4) is cup-shaped and comprises a raised circumferential wall (16), which seals against an inner circumference of the jet regulator housing (2), on the outlet end side, there is held an outlet disk (3) which is insertable into the jet regulator housing (2) and is pivotable therein, the outlet disk (3) has a perforated, grate and/or mesh structure with throughflow openings (5), and the outlet disk (3) bears the manually deformable, dimensionally elastic plastic lining (4), the raised circumferential wall (16), provides a seal between the outer circumference of the outlet disk (3) and the housing inner circumference of the jet regulator housing (2), and a central cam is integrally formed on the jet splitter (10) on the outflow side, said cam, during the pivoting of the outlet disk (3), is supported on the outlet disk (3) or on a central cam (17) integrally formed on the outlet disk (3) on an upstream side, wherein the outlet disk (3) and the manually deformable dimensionally elastic plastic lining (4) are held on one another in a manner secure against rotation and wherein the outlet disk (3) is comprised of a material that is harder than the material from which the manually deformable dimensionally elastic plastic lining (4) is comprised.

25. Jet regulator (1, 100, 101) having a ring-shaped or sleeve-shaped jet regulator housing (2) in which there is provided a jet splitter (10) dividing inflowing water into a multiplicity of individual jets, and having a manually deformable, dimensionally elastic plastic lining (4) provided on the outlet end side of the jet regulator housing (2), said manually deformable dimensionally elastic plastic lining (4) is cup-shaped and comprises a raised circumferential wall (16), which seals against an inner circumference of the jet regulator housing (2), on the outlet end side, there is held an outlet disk (3) which is insertable into the jet regulator housing (2) and is pivotable therein, the outlet disk (3) has a perforated, grate and/or mesh structure with throughflow openings (5), and the outlet disk (3) bears the manually deformable, dimensionally elastic plastic lining (4), the raised circumferential wall (16), provides a seal between the outer circumference of the outlet disk (3) and the housing inner circumference of the jet regulator housing (2), and a central cam (17) is integrally formed on the outlet disk (3) on the upstream side, said cam, during the pivoting of the outlet disk (3), is supported on a downstream portion of the jet splitter (10) and wherein the outlet disk (3) and the manually deformable dimensionally elastic plastic lining (4) are held on one another in a manner secure against rotation and have throughflow openings (5, 7) merging into each other.

* * * * *